US006790069B2

(12) United States Patent
Okita et al.

(10) Patent No.: US 6,790,069 B2
(45) Date of Patent: Sep. 14, 2004

(54) IC SOCKET WITH RESISTANT MECHANISM

(75) Inventors: Masao Okita, Furukawa (JP); Hsiu-Yuan Hsu, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/605,819

(22) Filed: Oct. 29, 2003

(65) Prior Publication Data

US 2004/0147152 A1 Jul. 29, 2004

(30) Foreign Application Priority Data

Jan. 29, 2003 (TW) ..... 92101909 A

(51) Int. Cl.[7] ..... H01R 13/62
(52) U.S. Cl. ..... 439/331; 439/73
(58) Field of Search ..... 439/331, 73, 70, 439/71

(56) References Cited

U.S. PATENT DOCUMENTS 5,648,893 A * 7/1997 Loo et al. ..... 439/331
5,997,316 A * 12/1999 Kunzel ..... 439/73
6,154,040 A * 11/2000 Tsukamoto et al. ..... 439/331
6,162,066 A * 12/2000 Glick et al. ..... 439/73
6,341,970 B1 1/2002 Ho et al.
6,454,587 B1 * 9/2002 Malone ..... 439/331
6,533,589 B1 * 3/2003 Palaniappa et al. ..... 439/331
6,607,396 B1 * 8/2003 Ito ..... 439/331
6,672,881 B2 * 1/2004 Evans ..... 439/331

* cited by examiner

*Primary Examiner*—Tho D. Ta
(74) *Attorney, Agent, or Firm*—Wei Te Chung

(57) ABSTRACT

An IC socket (1) includes a base (2) mounted on a printed circuit board, a lid (3) engaged onto the base, and a resistant mechanism (4). The base defines a plurality of assembly holes (24), and each assembly hole includes a blocking surface and a through hole. The resistant mechanism includes a pole having a first blocking member (41), a washer (45), a spring member (43) and a second blocking member (44). The spring member bears against the blocking surface, and said pole extends through a washer, a spring member and the through hole of the base, the extended end of the pole engages with the second blocking member. The lid includes a plate (31) having holes (311), said hole includes receiving hole (3112) and step (3113), and the diameter of the receiving hole is bigger than an external diameter of the first blocking member and smaller than the step.

14 Claims, 4 Drawing Sheets

IC SOCKET WITH RESISTANT MECHANISM

BACKGROUND OF INVENTION

1. Field of the Invention

The present invention relates to an IC socket for electrically connecting an electronic package such as an integrated circuit (IC) with a circuit substrate such as a printed circuit board.

2. Description of Related Art

IC sockets are widely used for receiving and testing of IC packages in semiconductor industry. A conventional IC socket comprises a base mounted on a printed circuit board, and a lid movably engaged on the base. An IC package is assembled between the base and the lid to connect with the printed circuit board. Commonly, a plurality of coil springs is disposed between the base and the lid, abutting against the base and the lid and providing support therebetween. This kind of IC socket is shown in U.S. Pat. No. 6,341,970 to Han Shin Ho et al., dated Jan. 29, 2002.

Referring to FIGS. 5–6, a conventional IC socket is illustrated. The IC socket 6 comprises a base 61 mounted on a printed circuit board (not shown), a lid 62 movably mounted on the base 61, and a plurality of coil springs 63 disposed therebetween. The base 61 comprises a substantially rectangular configuration having four side walls, an engaging surface 610, and a mounting surface 612 for mounting an IC socket 64 to the printed circuit board. Each of the two opposite side walls of the base 61 defines a step 613 along an upper edge thereof. Each corner of the base 61 defines an assembly hole 614 having a bottom in the base 61 for accommodating a spring 63 therein, and one end of the spring 61 extends out of the engaging surface 610 of the base 61. The lid 62 comprises a plate 621 and four hooks 622 depending from two opposite edges of the plate 621, corresponding to the two steps 613.

In assembly, the lid 62 is pressed downwardly towards the base 61, and the lower surface of the lid 62 touches the top ends of the extending springs 63. When the lid 62 is mounted onto the base 61, the spring 63 is pressed, and the steps 613 of the base 61 engage with the four hooks 622 for preventing the lid 62 from departing from the base 61. Therefore, the springs 63 are sandwiched between the base 61 and the lid 62. In use, an IC chip 64 is disposed between the base 61 and lid 62. When the lid 62 is pressed downwardly, the IC chip 64 is clipped between the lid 62 and the base 61 for connecting with the PCB via the base 61.

However, one problem with this type of IC socket is that the compressed spring 63 between the lid 62 and the base 61 will inversely press the lid 62 when the lid 612 is mounted on the base. Therefore, the lid 62 may probably warp or distort under said pressure before it is pressed to clip the IC chip 64 onto the base 61, thereby affecting reliable mechanical and electrical characters of the IC socket.

In view of the above, a new IC socket with resistant mechanism which overcomes the above-mentioned disadvantages is desired.

SUMMARY OF INVENTION

Accordingly, an object of the present invention is to provide an IC socket with resistant mechanism for reducing the distortion of the lid under the pressure of the springs.

To achieve the above-mentioned object, an IC socket in accordance with a preferred embodiment of the present invention comprises a base mounted on a printed circuit board, a lid engaged onto the base, and a resistant mechanism disposed therebetween. The base comprises an engaging surface for supporting the IC chip and a mounting surface for connecting with the printed circuit board, a plurality of passageways is defined between the engaging surface and the mounting surface. Each corner of the base defines an assembly hole, and each assembly hole comprises a blocking surface near the mounting surface, a through hole extending from the blocking surface to the mounting surface of the base. The resistant mechanism comprises a pole with a first blocking member at one end thereof, a coil spring surrounding the pole, and a washer disposed between the first blocking member and corresponding end of the coil spring. The external diameter of the washer is bigger than the first blocking member. The lid comprises a plate and four hooks depending from two opposite edges of the plate, and the plate defines holes aligning with corresponding assembly hole of the base. The hole comprises a receiving hole for accommodating the first blocking member of the pole, and a circular step near to the bottom surface of the plate for pressing the washer. That is, the diameter of the receiving hole is bigger than the external diameter of the first blocking member, and smaller than the diameter of the circular step.

In assembly, the pole extends through the washer and the coil spring in sequence. The pole with the surrounding coil spring inserts into the assembly hole of the base, and one end of the coil spring bears against the blocking surface of the assembly hole. The inserted end of the pole extends through the through hole and locates in the recess of the mounting surface to engage with the second member. Therefore, the coil spring is restricted between the washer and the blocking surface of the assembly hole.

The lid is pressed downwardly towards the base, and the hooks deflect outwardly as they ride over the steps of the base. The lid is attached onto the base by the loose engagement of the hooks and the steps, with the first blocking member of the pole fittingly inserted into the receiving hole, and the washer loosely depending on the circular step. Therefore, the spring will not perform extra pressure to the lid besides supporting the weight thereof before the lid is pressed downwardly to clip the IC chip on the base, and the distortion of the lid is effectively reduced.

Other objects, advantages and novel features of the invention will become more apparent from the following detailed description when taken in conjunction with the accompanying drawings, in which:

DETAILED DESCRIPTION

Reference will now be made to the drawings to describe the present invention in detail.

Figure 1:
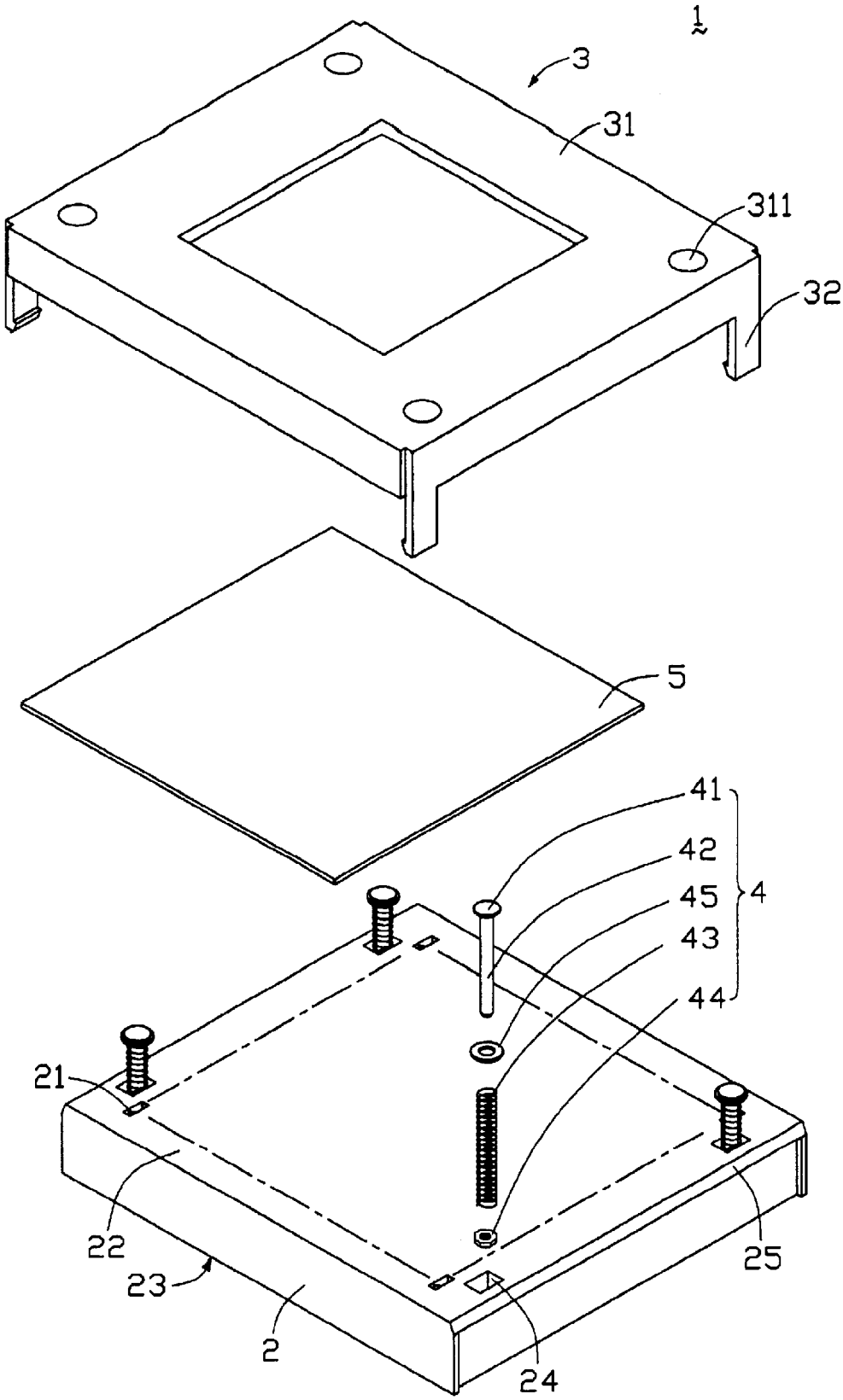
FIG. 1 is a simplified, exploded isometric view of an IC socket in accordance with the preferred embodiment of the present invention, together with an IC chip disposed between the lid and the base.
Figure 2:
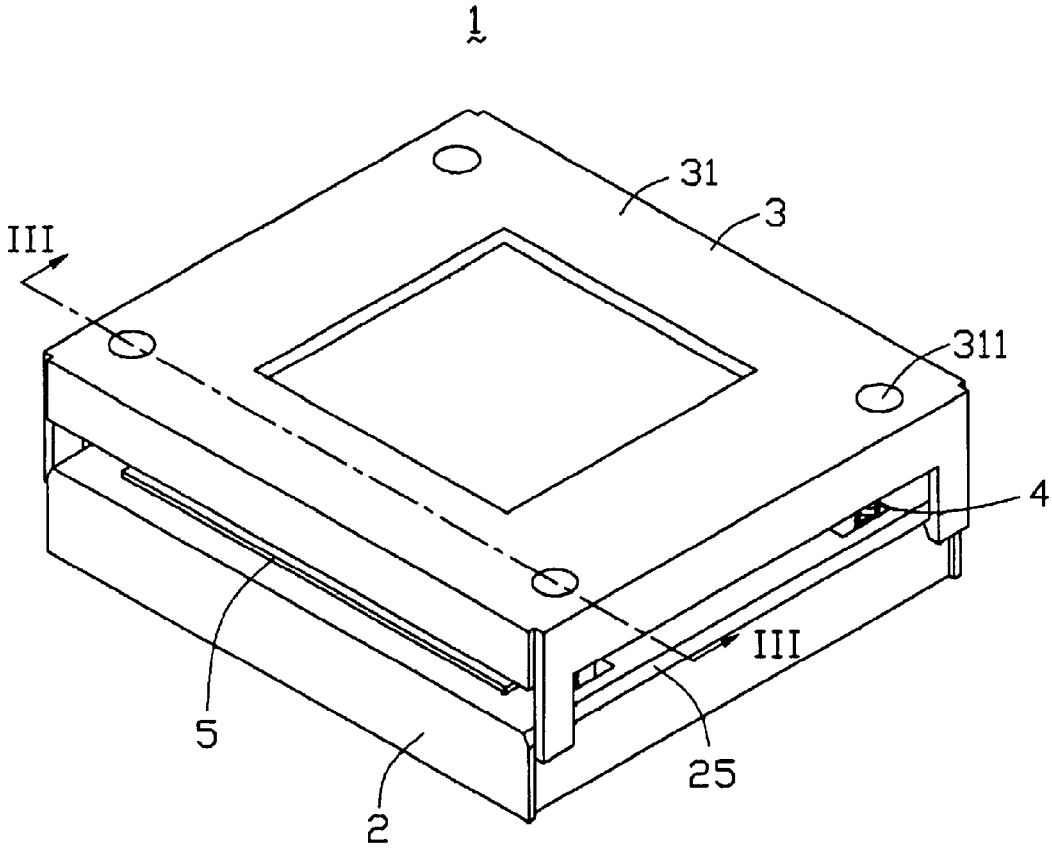
FIG. 2 is a simplified, isometric view of the IC socket of FIG. 1, showing the lid mounted onto the base.
Figure 3:
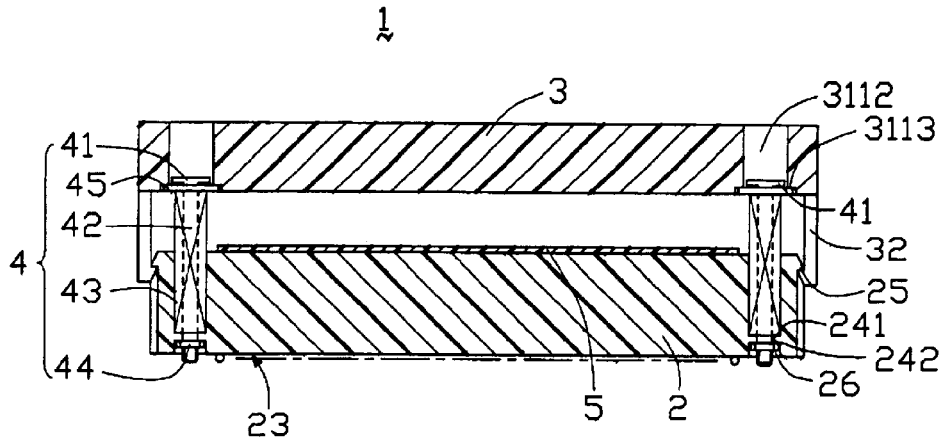
FIG. 3 is a cross-sectional view taken along line III—III of FIG. 2.

Referring to FIGS. 1–3, an IC socket 1 of the present invention comprises a base 2 mounted on a printed circuit board (not shown), a lid 3 covered on the base 2, and a resistant mechanism 4 sandwiched between the base 2 and the lid 3. In addition, an IC chip is disposed between the base 2 and the lid 3 to contact with the printed circuit board via the IC socket.

The base 2 has a generally rectangular configuration, and a plurality of electrical contacts 21 received therein. The base comprises a supporting surface 22 for supporting the IC chip, a mounting surface 23 facing the printed circuit board, and four side walls defined between the supporting surface 22 and the mounting surface 23. Each of two opposite side walls of the base 2 defines a triangle-sectioned step 25 along the upper edge of corresponding side wall respectively. Each corner of the base defines an assembly hole 24, and the assembly holes extend from the supporting surface 22 to the mounting surface 23. Each assembly hole 24 comprises a blocking surface 241 near the mounting surface 23 and a through hole 242 extends from the blocking surface 241 to the mounting surface 24 of the base 2. In the preferred embodiment, the opening of the through hole 242 in the mounting surface defines a larger recess 26 to receive a second blocking member 44. In the preferred embodiment, the second blocking member 44 is a nut.

The resistant mechanism 4 comprises a pole 42 with a first blocking member 41 at one end thereof, a spring member 43 surrounding the pole 42, and a washer 45 with lager external diameter than the first blocking member 41 disposed between the first blocking member 41 and corresponding end of the spring member 4. The diameter of the first blocking member 41 is bigger than the diameter of the pole 42, and smaller than the external diameter of the washer 45. In the preferred embodiment, the spring member 43 is coil spring.

In assembly, the pole 42 extends through the washer 45 and the coil spring 43 in sequence. The pole 42 with the surrounding coil spring 45 inserts into the assembly hole 24 of the base 2, and one end of the coil spring bears against the blocking surface 241 of the assembly hole 24. The inserted end of the pole extends through the through hole and locates in the recess 26 of the mounting surface 23 to engage with the second member 44. Therefore, the coil spring is restricted between the washer 45 and the blocking surface 241 of the assembly hole 24.

The lid 3 comprises a generally rectangular configuration plate 31 and four hooks 32 depending from two opposite edges of the plate 31 for clasping corresponding steps 25 of the base 2. The plate 31 defines four holes 311 aligning with the first blocking member 41 of the pole 42. Each hole 311 comprises a receiving hole 3112 for accommodating the first blocking member 41 of the pole 42, and a circular step 3113 near to the bottom surface of the plate 31 for pressing the washer 45. That is, the diameter of the receiving hole 3112 is bigger than an external diameter of the first blocking member 41, and smaller than the diameter of the circular step 31.

When the plate 31 is mounted onto the base, the hooks 32 loosely engage with the steps 25 of the base 2, the first blocking member 41 enters the receiving hole 3112, and the washer 45 loosely depends on the circular step 3113 to support the lid. In this condition, the coil spring 43 is pressed little just by the weight of the lid, and little pressure of the spring 43 will hardly press the lid 3 to distort. Therefore, better coplanarity of the plate 31 is ensured.

Figure 4:
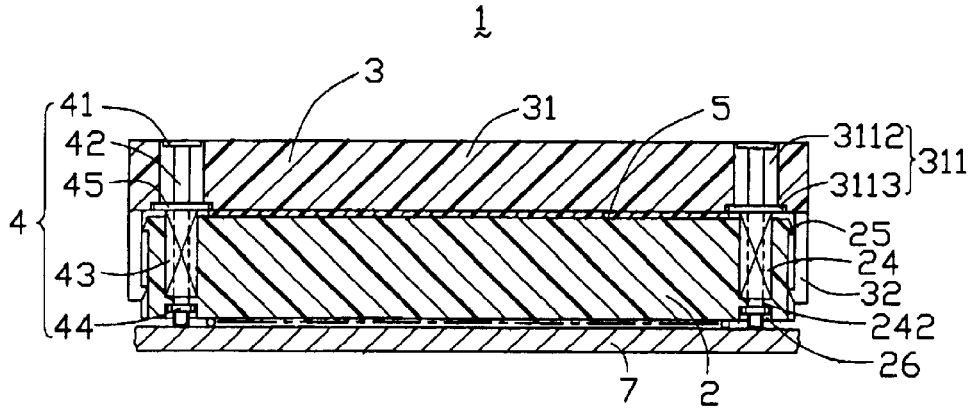
FIG. 4 is similar to FIG. 3, but showing the lid in a closed position to clip the IC chip on the base.
Figure 5:
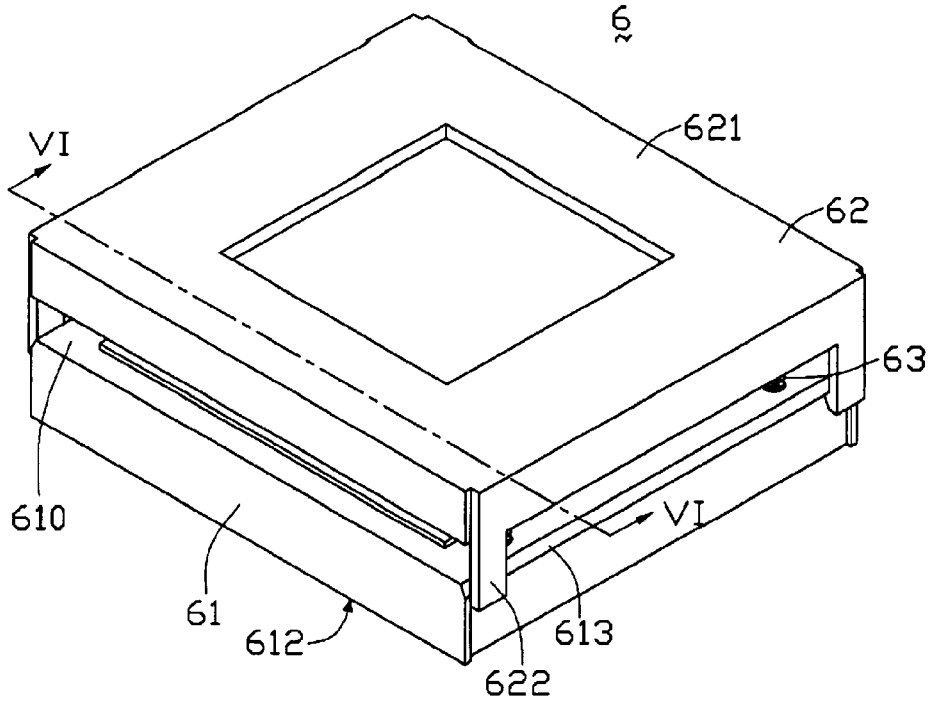
FIG. 5 (PRIOR ART)
FIG. 5 is a simplified, isometric view of a conventional IC socket, showing the lid mounted onto the base.
Figure 6:
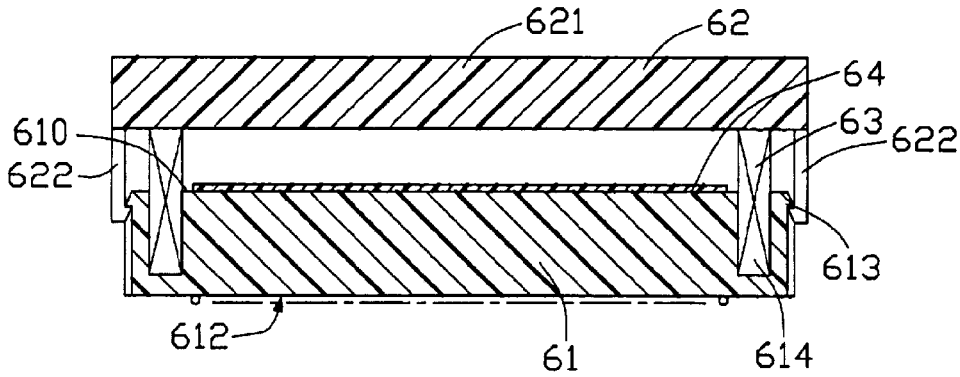
FIG. 6 (PRIOR ART)
FIG. 6 is a cross-sectional view taken along line VI—VI of FIG. 5.

Referring to FIG. 4, the IC socket is mounted onto a printed circuit board 7, and the lower ends of the poles 42 fittingly depend thereon. When the assembled lid 3 is pressed downwardly to clip the IC chip 5, the coil springs 43 are compressed by the washers 45 and the circular steps 3113 of the lid 3. Because the lower ends are depended on the printed circuit board, the first blocking member 41 of the pole 42 in the receiving hole 3112 is then spaced from the washer 45. The pressed lid 3 and the base 2 sandwich the IC chip therebetween to contact with the printed circuit board 7. When the pressure is released, the lid 3 moves upwardly under the pressure of the compressed spring 43, and moves back to former position, therefore the pressure from the spring 43 to the lid 3 is also released. Alternatively, instead of being supported by the printed circuit board 7, the second blocking member 44 may be held by the base 2 in the vertical direction. It also allows the pole 42 stays to be in a stationary position relative to the base 2.

In another embodiment, when the resistant mechanism 4 is assembled in the base 2, the spring member 43 is inserted in the assembly hole 24 first, and then the pole 42 is inserted into the through hole 242 from the opening of the mounting surface 23, therefore, the first blocking member 41 of the pole 42 is received in the recess 26 of the mounting surface 23. Press the spring member, and the top end of the pole 42 will extend out the spring member 43. A second blocking member is attached on the extended end to restrict the spring member 43 between the second blocking member and the blocking surface 241 of the base 2. The restricted spring member will hardly press the lid before the lid is press downwardly, therefore the distortion from the spring member 43 is also reduced.

While a preferred embodiment in accordance with the present invention has been shown and described, equivalent modifications and changes known to persons skilled in the art according to the spirit of the present invention are considered within the scope of the present invention as defined in the appended claims. For example, the spirit of the invention is to release the lid from the spring urging force when the lid is in the upper position. Thus, instead of using engagement between the first blocking member 41 and the washer 45 to absorb most of the spring forces when the lid 3 is in the upper position, using engagement between the washer and the proper upper portion of the base to absorb most of the spring forces, may be another possible approach for preventing improper forces imposed upon the lid when the lid is located in an upper/relaxed position.

What is claimed is:

1. An IC socket for electrically connecting an IC chip to a printed circuit board comprising:

a base mounted on the printed circuit board, said base comprising an engaging surface, a mounting surface, and a plurality of assembly holes defined between the engaging surface and the mounting surface, said assembly hole comprising a blocking surface and a through hole defined between the blocking surface and the mounting surface;

a plurality of resistant mechanism assembled in the assembly holes, each resistant mechanism comprising a pole having a first blocking member at one end thereof, a washer, a spring member and a second blocking member, said spring member bearing against the blocking surface of the assembly hole, said pole extending through the washer, the spring member and the through hole of the base, one end of the pole extending out therefrom, the extended end of the pole engaging with a second blocking member; and a lid mounted on the base and defining holes aligned with corresponding poles of the resistant mechanism, said hole comprising a receiving hole for accommodating the first blocking member and a step for pressing the washer, the diameter of the receiving hole being larger than an external diameter of the blocking member near to the cover and smaller than a diameter of the step.

2. The IC socket as claimed in claim 1, wherein the second blocking member is a nut.

3. The IC socket as claimed in claim 1, wherein the spring member is a coil spring.

4. The IC socket as claimed in claim 1, wherein the pole extends through a washer, a spring member and the through hole of the base in sequence.

5. The IC socket as claimed in claim 1, wherein the pole extends through the through hole of the base, the spring member and the washer in sequence.

6. The IC socket as claimed in claim 1, wherein four side walls are defined between the engaging surface and the mounting surface.

7. The IC socket as claimed in claim 6, wherein each of two opposite side walls of the base defines a triangle-sectioned step, and a corresponding edge of the lid defines hooks for engaging with the step.

8. An IC socket assembly comprising:

a stationary base;

a lid mounted upon the base and slidable relative to said base in a vertical direction; and a plurality of resistant mechanisms disposed in a periphery region of the base, respectively, each of said resistant mechanisms including a spring device; wherein each of said resistant mechanism defines a moveable upper structure which constantly receives an upwardly urging force due to said spring device so as to engage the lid and further resist downward movement of the lid when said lid is in a tensioned condition, while said moveable upper structure abuts against a fixed portion of either the resistant mechanism or the base when said lid is in a relaxed condition so as to prevent said upwardly urging force from applying to the lid when said lid in the relaxed condition;

wherein said spring is movably located in a corresponding hole in the base.

9. The IC socket assembly as claimed in claim 8, wherein said moveable upper structure is a washer associated with an upper end of the spring.

10. The IC socket assembly as claimed in claim 8, further including an interlocking device on said base and said lid for preventing the lid from be dropped from the base when said lid is in the relaxed condition.

11. The IC socket assembly as claimed in claim 8, wherein said resistant mechanism includes a pole, and said fixed portion is a first blocking member attached to an upper end of the pole.

12. The IC socket assembly as claimed in claim 11, wherein said resistant member further includes a second blocking member attached to a lower end of the pole.

13. The IC socket assembly as claimed in claim 12, wherein said base is seated upon the a printed circuit board.

14. The IC socket assembly as claimed in claim 13, wherein the lower end of the pole is supportably seated upon the printed circuit board.

* * * * *